US005739679A

United States Patent [19]

Takehara et al.

[11] Patent Number: 5,739,679

[45] Date of Patent: Apr. 14, 1998

[54] COLD CATHODE TUBE LIGHTING DEVICE USING PIEZOELECTRIC TRANSFORMER

[75] Inventors: Takao Takehara, Shizuoka; Shingo Okada, Saijou, both of Japan

[73] Assignee: Minebea Co., Ltd., Kitasaku, Japan

[21] Appl. No.: 707,761

[22] Filed: Sep. 4, 1996

[30] Foreign Application Priority Data

Sep. 4, 1995 [JP] Japan ..... 7-250194

[51] Int. Cl.[6] ..... G05F 5/00

[52] U.S. Cl. ..... 323/299; 323/222; 363/131

[58] Field of Search ..... 363/15, 16, 95, 363/97, 131; 323/299, 222

[56] References Cited

U.S. PATENT DOCUMENTS

| | | | |
|---|---|---|---|
| 4,642,533 | 2/1987 | Carpenter | 315/408 |
| 5,216,585 | 6/1993 | Yasumura | 363/19 |
| 5,450,307 | 9/1995 | Yasumura | 363/47 |
| 5,490,052 | 2/1996 | Yoshide et al. | 363/15 |

FOREIGN PATENT DOCUMENTS

| | | |
|---|---|---|
| 0665600A1 | 8/1995 | European Pat. Off. . |
| 0706306A2 | 4/1996 | European Pat. Off. . |

*Primary Examiner*—Adolf Berhane
*Attorney, Agent, or Firm*—Staas & Halsey

[57] ABSTRACT

This invention solves various problems of an inverter device caused by a winding transformer by using a piezoelectric transformer, and also provides a drive device for a cold cathode tube using a piezoelectric transformer so as to enable lighting and light control of the cold cathode tube. In a cold cathode tube lighting device having a cold cathode tube and piezoelectric circuit to light the cold cathode tube, a series resonance circuit is formed at primary side of the piezoelectric transformer. An operation control device is installed for ON-OFF control of the series resonance circuit, by a switching element, at timing with the phase advanced from the resonance frequency of the resonance circuit, and a chopper circuit for stepping-up the input voltage and supplying a power source to the resonance circuit is installed, and ON-OFF control of the power switching element of the chopper circuit is performed by the operation control device. That is, the power switch of the step-up chopper circuit is driven at the ON-time larger than that of the power switch of the inverter, and the cold cathode tube is connected to the secondary side of the step-up transformer.

6 Claims, 12 Drawing Sheets

(a) OPTIMUM OPERATION OF CLASS E (b) OPERATION OF SEMI-CLASS E

WAVE FORMS OF CLASS E OF RESONANT TYPE INVERTER

NOTES: S IS AN INPUT SIGNAL OF SWITCHING DRIVE

+
-
L2
R1
D2
Q1
T1
※INPUT: VREF
CFL1
R12
D3
C14
VR1
R13
Q4
C7
C5
R3
※
IC1
SOFT START
ON/OFF
FET DRIVER
IC3
※
5 SEC COUNTER
ONE SHOT 1
PFM LOGIC
VCO
A1
5V GENERATOR
VREF
R5
C3
R4
CL
R7
R6

COLD CATHODE TUBE LIGHTING DEVICE USING PIEZOELECTRIC TRANSFORMER

BACKGROUND OF THE INVENTION

1. Field of the Invention

The present invention relates to the inverter devices suitable as a power source of a load requiring current control in wide range, and more particularly relates to an inverter device suitably used in a power source where a cold cathode tube with light controlled freely is a load.

2. Description of the Prior Art

An inverter device is a device which converts DC power into AC power, and is used as so-called reverse converting device in various sorts of electric machinery and apparatus.

FIG. 13 is a circuit diagram showing an inverter device in the prior art, which is used for a discharge tube. In FIG. 13, T10 is a step-up transformer for a Royer oscillation circuit provided with a primary coil 10P, a secondary coil 10S and a feedback coil 10F. TR11, TR12 are transistors of NPN type for switching operation, which constitute a Royer oscillation circuit together with the step-up transformer T10. C13 is a capacitor for voltage resonance, and L14 is a choke coil also for voltage resonance. Thereby when the transistors TR11, TR12 are at the OFF state, the collector-emitter voltage becomes sine wave, and voltage waveform of the primary coil 10P and the secondary coil 10S of the step-up transformer T10 becomes sine wave. The choke coil L14 is connected to a DC-DC converter as described later, and a cold cathode tube CFL31 is connected to the output side. By the inverter automatic oscillation, high voltage of sine wave appears at the output side in frequency of several tens KHz unit and the cold cathode tube CFL31 is lit. IC20 is an integrated circuit (IC) which controls a base circuit of PNP type transistor TR21 for switching operation to constitute the DC-DC converter, and operates as a chopper circuit of step-down type. The IC has an oscillator OSC generating triangular wave, two operational amplifiers A1 and A2 for comparison, a PWM comparator COMP comparing the output voltage of the oscillator OSC with the output voltage of either the operational amplifier A1 and A2, and an output transistor 113 driven by the PWM comparator and driving base of the PNP transistor TR21 for switching operation as above described. In the IC20, the oscillator OSC is connected to one PWM comparator input circuit of the PWM comparator COMP and the two operational amplifiers A1, A2 are connected to other PWM comparator input circuit for comparison with the oscillator OSC as above described, and higher output voltage among these two operational amplifiers is compared with output of the oscillator OSC.

In addition, the IC20 having the above-mentioned constitution is defined as IC for controlling DC-DC converter here, and even if this is used for other purpose, as long as inner configuration is not changed, this is called IC for controlling DC-DC converter. D22 is a flywheel diode, and L23 is a choke coil. C24 is a capacitor, and the choke coil L23 and the capacitor C24 constitute an LC filter. C25, R26 are a capacitor and a resistor respectively for determining the oscillation frequency. Capacitors C27, C29 and resistors R28, R30 are C, R elements for phase correction of the operational amplifiers A1, A2 of the IC 20 for controlling the DC-DC comparator. Diodes D15, D16 are for rectifying positive component of the discharge current flowing through the cold cathode tube CFL31. R18, C19 are a resistor and a capacitor constituting a low pass filter for converting the current waveform into the DC component. The filter output is connected to the positive input end of the operational amplifier A2 of the IC20 for controlling the DC-DC converter.

That is, voltage proportional to mean value at positive cycle of a discharge current is obtained across the capacitor C19, and this voltage and the reference voltage at the inside of the IC20 for controlling the DC-DC converter are compared in the operational amplifier A2, thus output voltage proportional to difference voltage between both compared voltages is obtained. As shown in FIG. 14, the output voltage and triangular wave output of the oscillator OSC of the IC20 for controlling the DC-DC converter are compared in the PWM comparator. That is, if the discharge current increases on account of any reason, the output voltage of the operational amplifier A2 operating as an error amplifier is transferred from the B line to the A line. As a result, the output of the PWM comparator is varied from the C line to the D line. That is, the ON-time of the PNP type transistor TR21 for switching operation being an output transistor becomes narrow, and the output voltage of the DC-DC comparator is decreased, and since the power source voltage of the Royer oscillation circuit is lowered, the discharge current is decreased.

Consequently, the constant-current control of the discharge current becomes possible. R32, R33 are resistors so that the output voltage of the DC-DC converter is made constant voltage, and these are resistors for detecting the output voltage of the DC-DC converter so that the voltage of the secondary coil 10S of the step-up transformer T10 is made constant, when the cold cathode tube CFL31 is not connected or before the discharge is started. The connecting point of the resistors R32, R33 is connected to the + input end of the operational amplifier A1 of the IC20 for controlling the DC-DC converter and constitutes the negative feedback loop, and the output voltage of the DC-DC comparator is made constant voltage. Since outputs of the operational amplifiers A1, A2 are connected in the OR connection, among the output voltage of the operational amplifiers A1, A2, higher voltage has priority and is inputted to the PWM comparator.

High voltage of about 1000~1500 V necessary for lighting the cold cathode tube is generated in that secondary side of the step-up transformer is wound in several thousands turns and voltage of 5~19 V is stepped up. Thin wire of about 40 microns is used for this winding. When such a winding transformer with a thin wire wound much is used, problems such as breaking of wire, layer short fault or the like are produced, and in order to prevent these faults, much working time is required. Also when a winding transformer is used in a personal computer of notebook type or the like where this shape is required, structural limitation exists in order to realize small size. As improvement measure, such system is being studied that a winding transformer is replaced by a piezoelectric transformer of a ceramic plate.

Moreover, in order to raise the step-up ratio of a piezoelectric transformer, such measure is required that plate thickness is made thin or dimension in width direction is increased. When the plate thickness is made thin, however, although the capacity of the driving part can be made large in comparison with the capacity of the power generating part, such defect exists that the output impedance becomes high and variation of the output voltage due to the load is increase. On the other hand, when measure of increasing the width dimension is taken, although the output impedance can be decreased, the electric machine coupling coefficients K31, K33 have shape dependence, and when value of width/length becomes 0.3 or more, since values of K31, K33 begin to be decreased, width can not be much widened, and when the width is increased over some degree, the step-up ratio is rather decreased. Consequently, when the miniaturization is considered, the step-up ratio has limitation. Also in order to obtain sufficient step-up ratio, it is performed that the stepping-up is performed by the winding transformer and the piezoelectric transformer is driven, but there is a problem that the device cost increases and the device becomes large size.

SUMMARY OF THE INVENTION

In view of such points, an object of the present invention is to provide a drive device of a cold cathode tube using a piezoelectric transformer, where various problems of the inverter device caused by a winding transformer are solved by using a piezoelectric transformer, and also lighting and light control of the cold cathode tube can be performed.

In order to attain the foregoing object of the present invention, in a cold cathode tube lighting device having a cold cathode tube and a piezoelectric circuit for lighting the cold cathode tube, the present invention provides a cold cathode tube lighting device using a piezoelectric transformer, characterized in that a series resonance circuit is formed at the primary side of the piezoelectric transformer, and operation control means is provided for ON/OFF operation of the series resonance circuit by a switching element at timing with phase advanced from the resonance frequency of the resonance circuit, a chopper circuit for stepping up the input voltage and supplying the power source to the resonance circuit is installed, the ON/OFF state of the power switching element of the chopper circuit is controlled by the operation control means, that is, the power switch of the step-up chopper circuit is driven by the ON-time larger than the ON-time of the power switch of the inverter, and the cold cathode tube is connected to the secondary side of the step-up transformer, further a feedback circuit obtaining a feedback signal from a current of the cold cathode tube and setting the switching condition of the switching circuit is added to the cold cathode tube lighting device, further a soft start circuit limiting the ON-time of the power switch of the inverter to definite time and lowering the switching frequency gradually from frequency higher than the resonance frequency of the piezoelectric transformer is added to the operation control means of the cold cathode tube lighting circuit, also a protective circuit is installed so that the ON-time of the power switch of the step-up chopper circuit is decreased as the input voltage becomes high, and when the cold cathode tube is not connected, it is prevented that the excessive power is applied to the piezoelectric transformer and the piezoelectric transformer is broken.

According to a cold cathode tube lighting device using a piezoelectric transformer of the present invention, since a lighting circuit is constituted using the piezoelectric transformer, the number of parts becomes little and the device can be constituted in small size and the product cost is reduced. Also since the resonance frequency of the piezoelectric transformer is made high, the lighting frequency of the discharge tube can be made high thereby the discharge efficiency becomes well.

DESCRIPTION OF THE PREFERRED EMBODIMENTS

Figure 1:
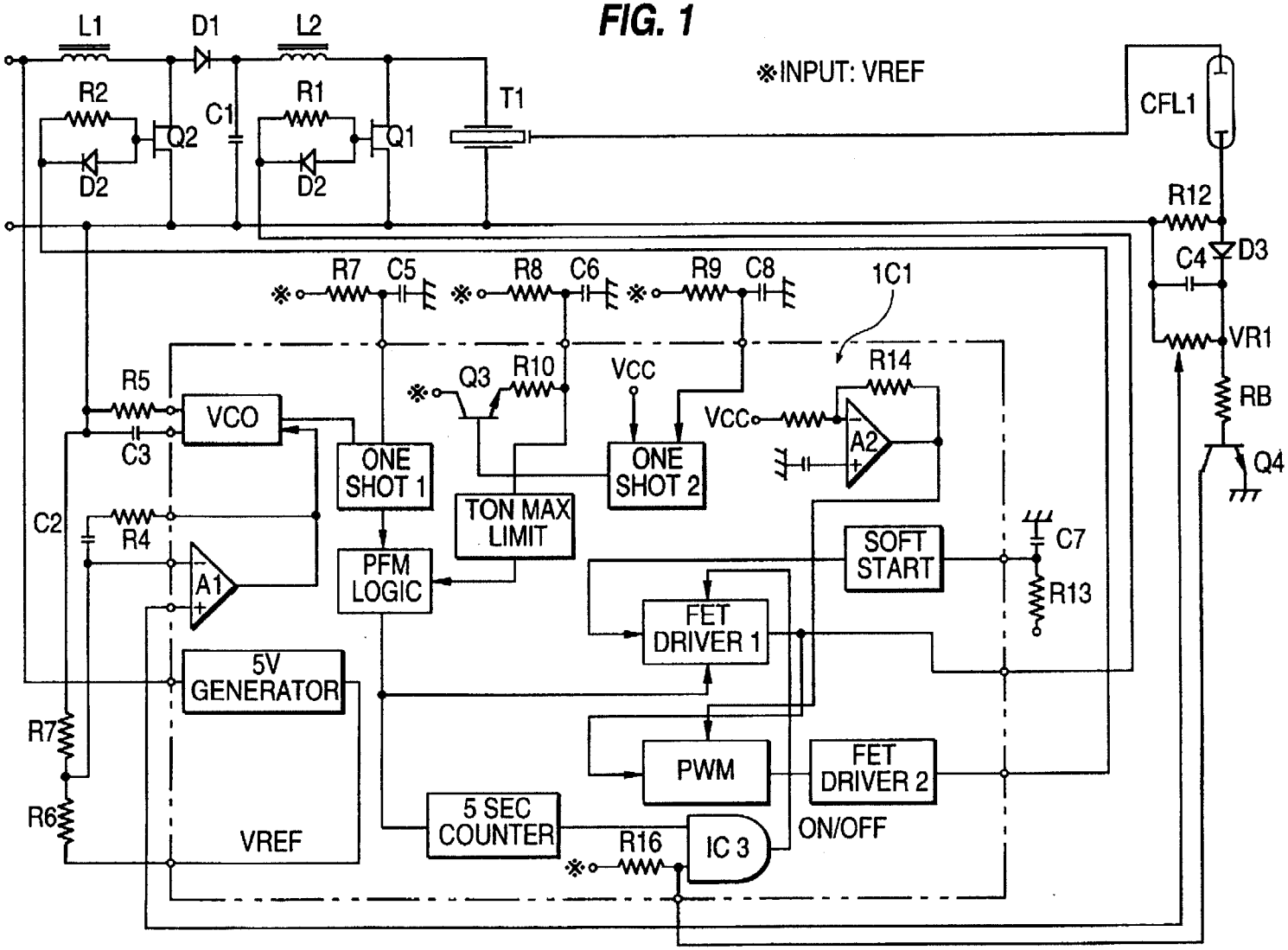
FIG. 1 is a circuit block diagram showing configuration of an embodiment of a cold cathode tube lighting device using a piezoelectric transformer according to the invention.
Figure 13:
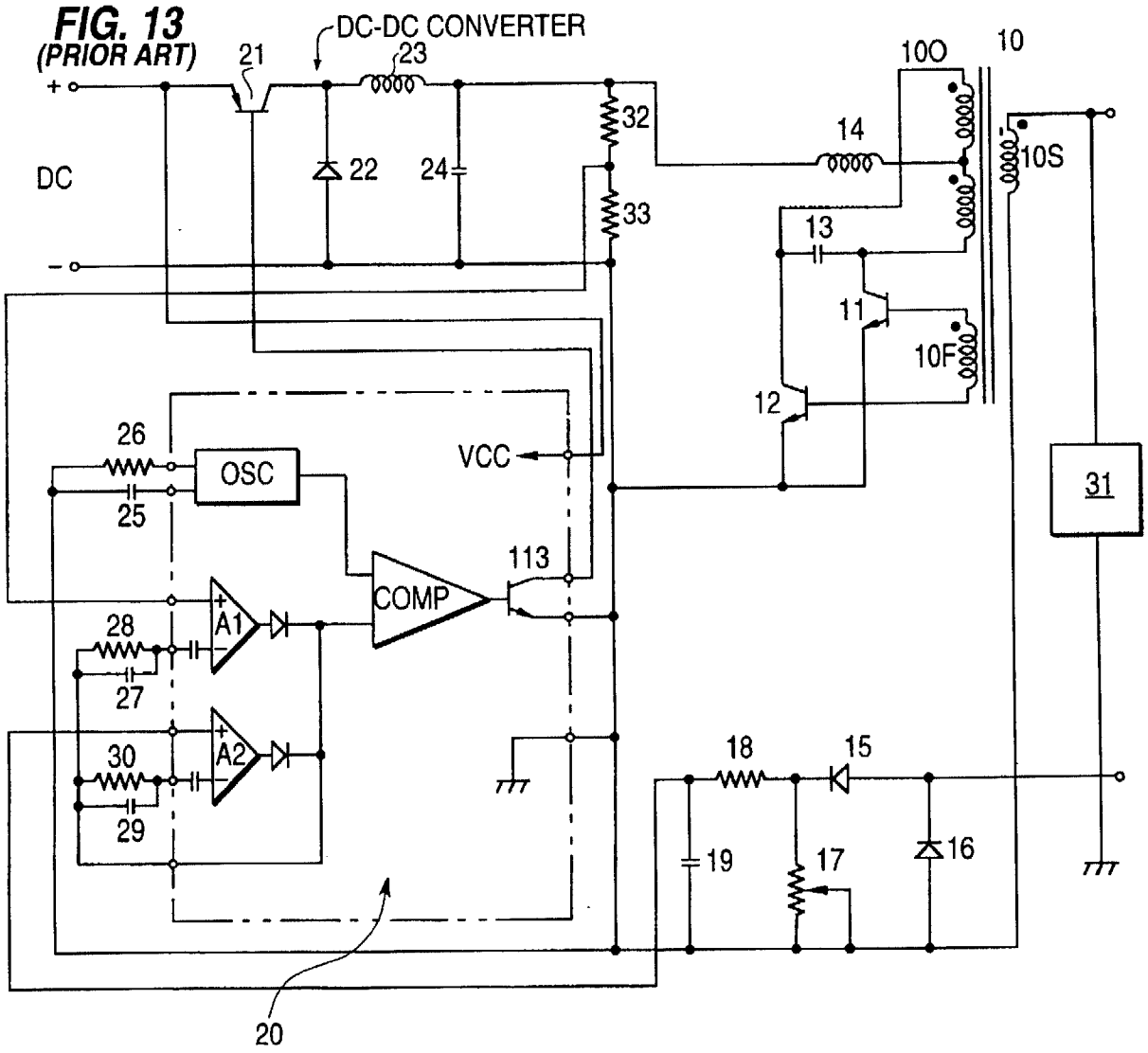
FIG. 13 (PRIOR ART)
FIG. 13 is a circuit diagram showing an inverter device used for a discharge tube in the prior art.
Figure 14:
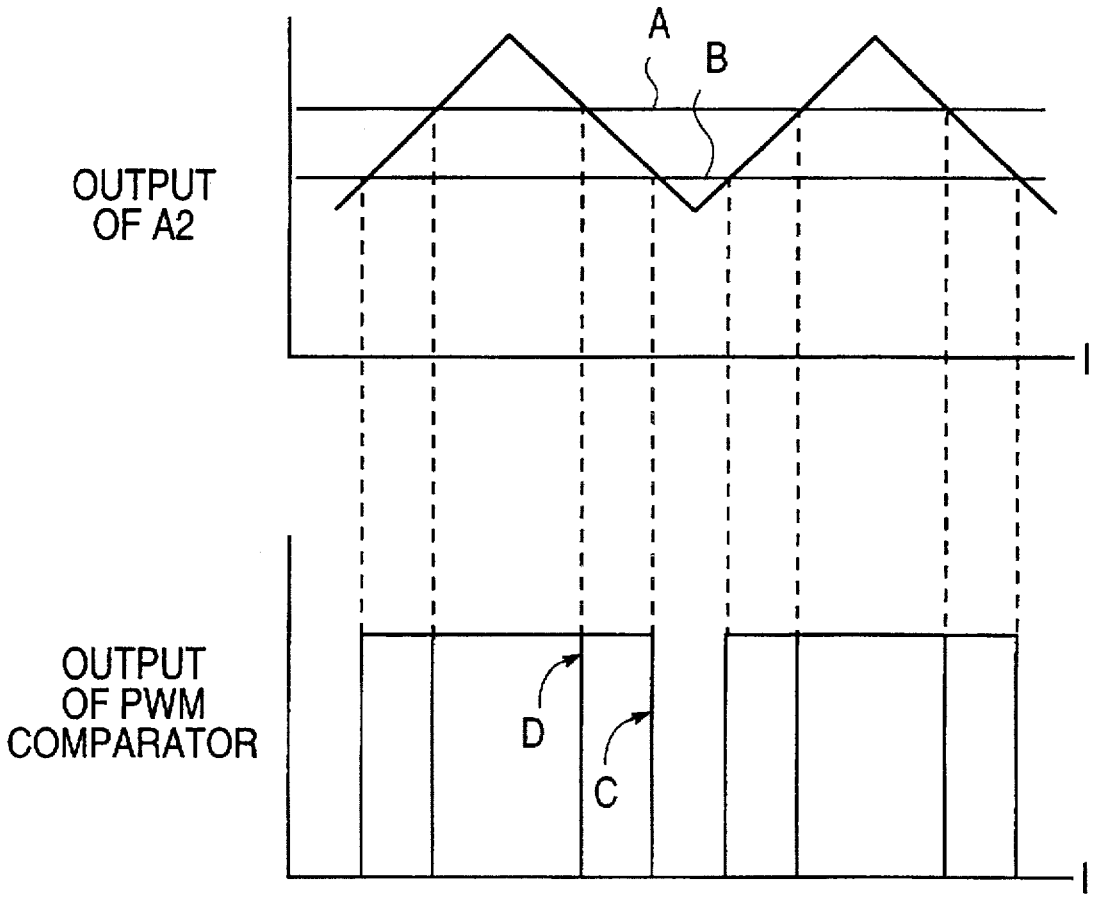
FIG. 14 (PRIOR ART)
FIG. 14 is a waveform chart of an inverter device in the prior art.

Next, an embodiment of the present invention will be described in detail using the accompanying drawings. FIG. 1 is a circuit diagram showing an embodiment of a cold cathode tube lighting device using a piezoelectric transformer according to the present invention. In the prior art shown in FIG. 13, although the power source voltage of the Royer oscillation circuit, i.e., the output voltage of the DC-DC converter is varied in response to value of the discharge current thereby the light control of the cold cathode tube is performed, in the present invention, quasi E-class voltage resonance type inverter is connected to a step-up type chopper and its output and cathode tube CFL1 is driven directly, and current flowing through the cold cathode tube CFL1 is subjected to negative feedback to a circuit driving a power switching element and the optimum light control is performed.

Figure 2:
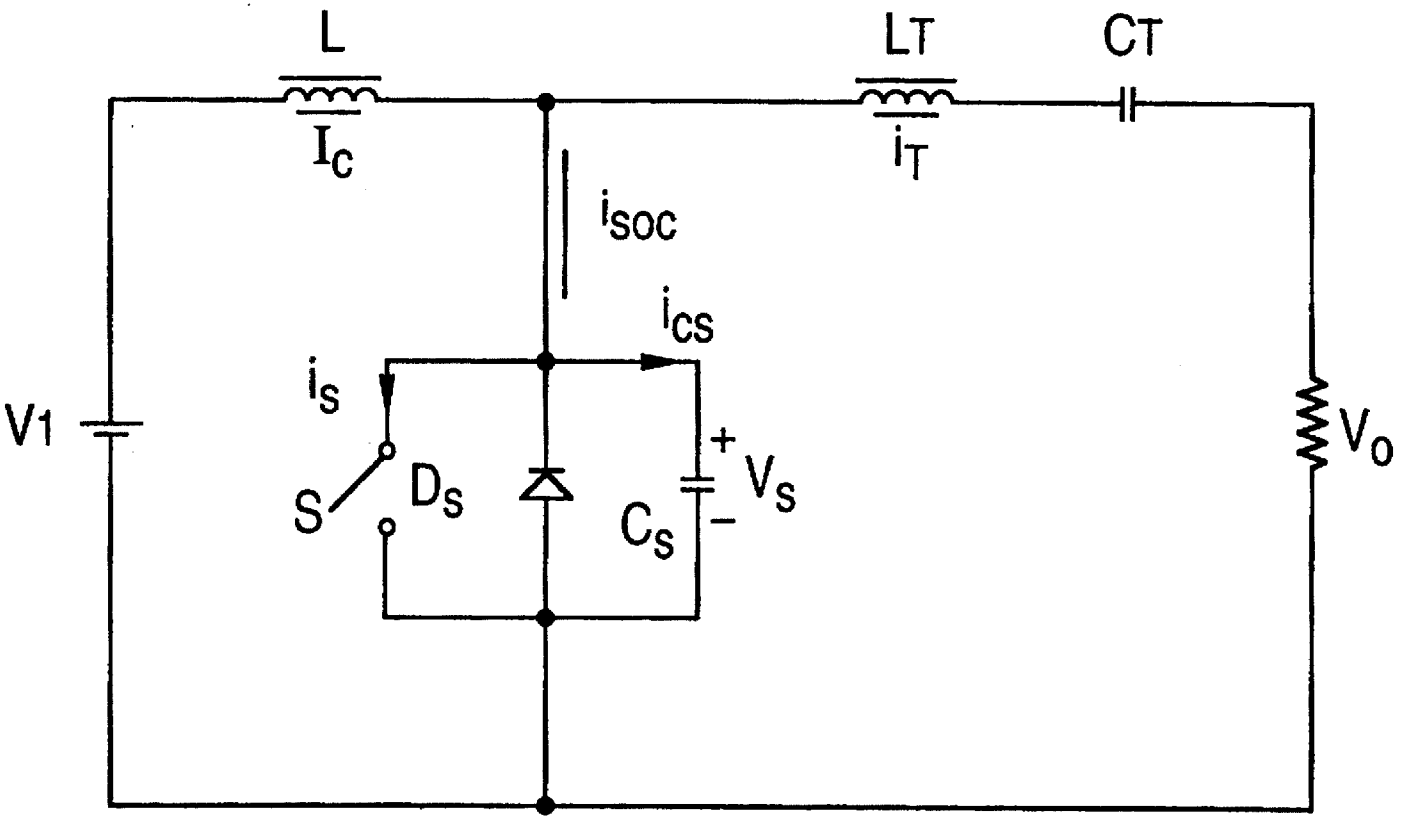
FIG. 2 is a basic circuit of a quasi E-class voltage resonance inverter.

Quasi E-class voltage resonance inverter is known as an inverter where both current flowing through a power switch and voltage impressed to the switch becomes a part of sine wave and sine wave output becomes possible. The operation principle will be described as follows. FIG. 2 shows a basic circuit of a quasi E-class voltage resonance inverter. In FIG. 2, a reactor L is a choke coil and its current approximately becomes direct current Ic. An inductor LT and a capacitor CT constitute a resonance circuit.

Voltage of pulse shape is applied to an RLC tuning circuit by ON/OFF operation of a switch. If the switching frequency is a little higher than the resonance frequency of Lt-CL, current flowing through R-Lt-Ct becomes approximately sine wave by the resonance circuit. In this case, the R-L-C tuning circuit has inductive reactance, and current It flowing the tuning circuit lags in the phase from the voltage impressed to the tuning circuit, i.e., fundamental wave of the voltage Vs of the switch. Here, since Tc=Tsdc+It, component of the DC current Ic subtracted by the sine wave current It becomes Isdc flowing through the parallel circuit of the switch S, the diode Ds and the capacitor Cs, and this becomes also sine wave.

Figure 3:
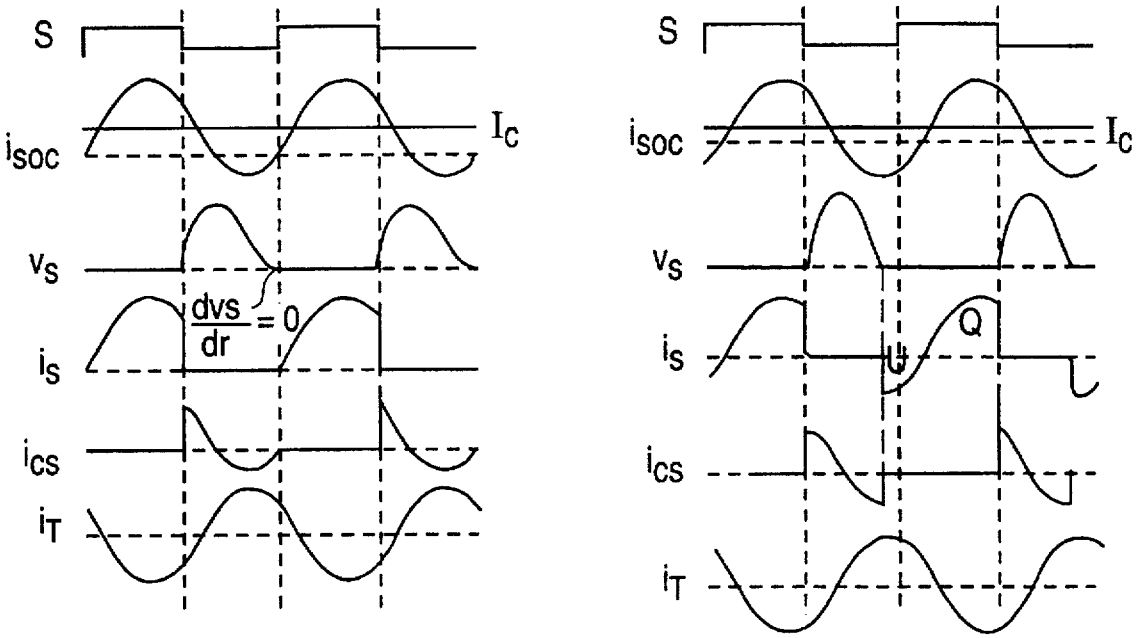
FIG. 3 is a waveform chart of each part of a quasi E-class voltage resonance inverter.

FIG. 3(*a*) shows operation waveform of an E-class resonance inverter when duty of a switch S is 50%. If the switch S is turned off, current of sine wave flows through a capacitor Cs, and the capacitor Cs is charged and the voltage Vs rises from zero in sine wave. Therefore the turn-off of the switch becomes switching in zero voltage and non-zero current. In the optimum load Ropt, as shown in FIG. 3(*a*), the voltage Vs drops to zero at the gradient dVs/dt close to zero, Vs=0, and when dVs/dt=0, the switch S is turned on. If the load is smaller than the optimum load Ropt, as shown in FIG. 3(*b*), the voltage VS is clamped to zero when the switch S is turned on. This is quasi E-class operation, and becomes zero voltage switching in similar manner to the voltage resonance switch. In operation as a switching regulator, E-class operation can not be performed throughout the whole variable range of the load and the input voltage and the quasi E-class operation is performed. Since the impedance of the R-L-C tuning circuit is sensitive to the switching frequency, when the output voltage VO (=It) is controlled by the switching frequency modulation, advantage is obtained in that variation of the switching frequency is little.

Figure 4:
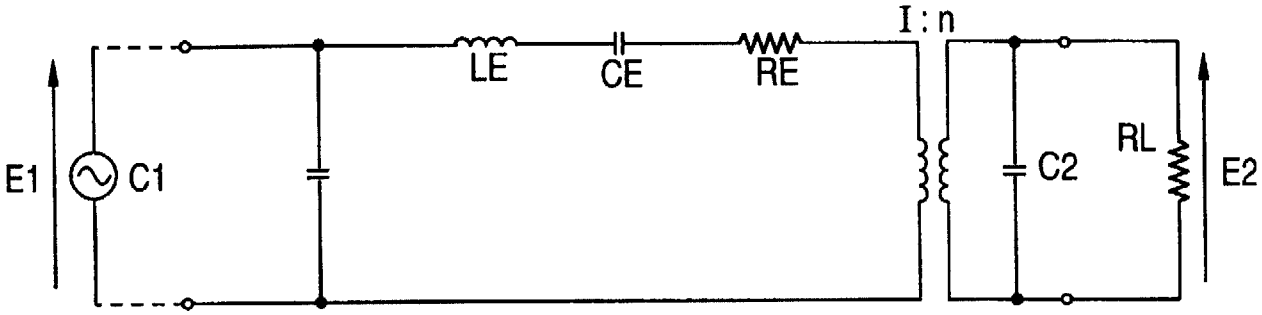
FIG. 4 is an equivalent circuit diagram of a piezoelectric transformer.
Figure 5:
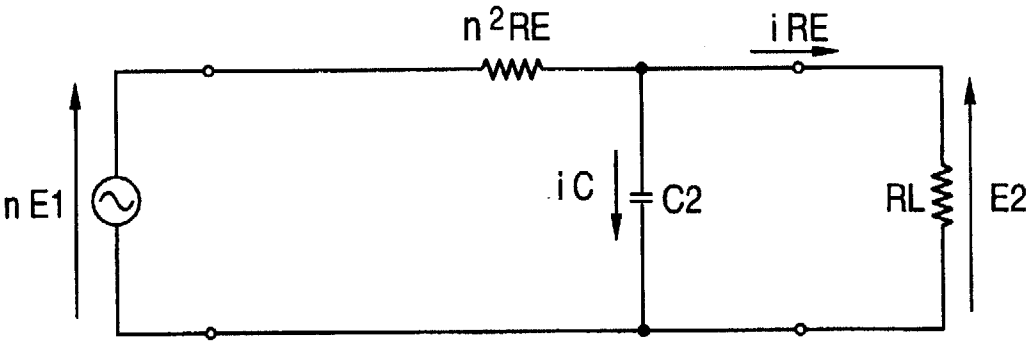
FIG. 5 is an equivalent circuit diagram of a piezoelectric transformer in resonance state.

In one embodiment of the present invention shown in FIG. 1, T1 is a piezoelectric transformer. FIG. 4 shows an equivalent circuit of a piezoelectric transformer. Here, C1 is input capacitance, C2 is output capacitance, LE is equivalent inductance, CE is equivalent capacitance, n is transformation ratio, and RL is load resistance. In further simplification, in condition that LE and CE are resonated, conversion to the secondary side becomes as shown in FIG. 5.

Referring to the description in FIG. 1, Q1 is a power MOSFET of N channel. L2 is a choke coil. The equivalent inductance LE and the equivalent capacitance CE of the piezoelectric transformer T1 constitute a resonance circuit, and the cold cathode tube CFL1 is connected in series to the resonance circuit. The resonance frequency of the resonance circuit becomes equation 1 as follows:

$$Fr = 1/2\pi\sqrt{LE \cdot CE} \quad (1)$$

The drain-source voltage at the OFF-state of the power MOSFET Q1 becomes sine wave by the choke coil L2 and the input capacitance C1 of the piezoelectric transformer T1. On the other hand, the choke coil L1, the power MOSFET (Q2), the diode D1 and the capacitor C1 constitute a step-up chopper circuit, and the stepped-up output voltage becomes input voltage of the quasi E-class inverter. The voltage resonance type control IC(IC1) controls the gate circuit of the power MOSFET (Q1) and the power MOSFET (Q2) of the step-up chopper circuit. The IC is controlled by a voltage control oscillator (VCO), an operational amplifier A1 and a switching frequency modulation circuit (PFM LOGIC), and comprises a gate control circuit (FET DRIVER 1) to control the gate of the power MOSFET (Q1). R4, C2 are for phase correction of the operational amplifier A1 of the IC1. R5, C3 are C-R element for determining the oscillation frequency of the voltage control oscillator VCO. R6, R7 are resistors for DC bias of the —input end of the operational amplifier A1 of the IC1.

Figure 6:
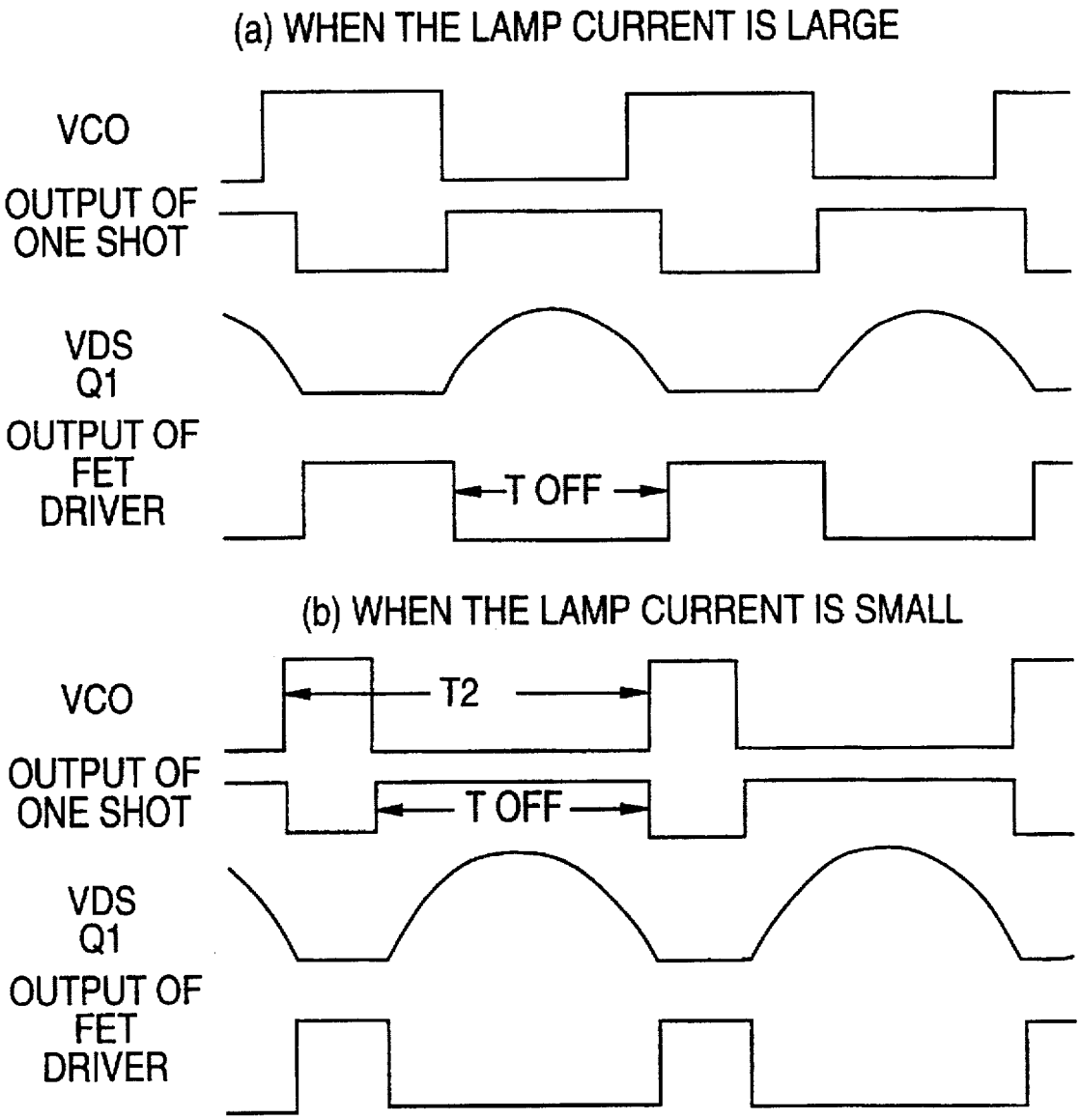
FIG. 6 is a waveform chart of each part of a cold cathode tube lighting device.

R1 is a gate drive resistor of the power MOSFET (Q1). D1 is a speed-up diode for drawing the gate storage charge. Lamp current is detected by a resistor R12, and positive cycle of the lamp current is detected by a diode D3 and a capacitor C4 and is converted into direct current. The output is connected through a variable resistor VR1 for setting lamp current to the plus input end of the operational amplifier A1 of the IC1. That is, voltage proportional to the mean value of the positive cycle of the discharge current is obtained at the center tap of the variable resistor VR1. The output voltage is connected to the input end of the voltage control oscillator VCO, and controls the oscillation frequency of voltage control oscillator. That is, if the discharge current is increased by any reason, the output of the operational amplifier A1 rises and the oscillation frequency of the voltage control oscillator VCO rises. A monostable multivibrator (ONE SHOT 1) is set at the fall of the output of the voltage control oscillator VCO, and the output becomes high level. A resistor R3 and a capacitor C5 are for determining the pulse width of the output of the monostable multivibrator (ONE SHOT 1), and the output of the monostable multivibrator (ONE SHOT 1) is held to high level at the time determined by the time constant of R3 and C5. FIG. 6 shows waveform of each part. Toff is set so that the quasi E-class operation is satisfied, considering variation of the oscillation frequency due to dispersion of the choke coil, the voltage resonance capacitor or the like or the temperature variation. That is, since the oscillation frequency rises while Toff remains constant, the ON-time of the switch is decreased. As a result, current supplied to the cold cathode tube CFL1 is decreased and the constant-current is held. If the lamp current is decreased, the output of the operational amplifier A1 is lowered and the oscillation frequency of the voltage control oscillator VCO is lowered and the constant—current control is performed. C7 is a capacitor for setting the delay time of the soft start circuit. If the power source is turned on, the oscillation frequency of the voltage control oscillator VCO becomes higher than that at the normal operation state and is gradually lowered as the capacitor C7 is charged.

In order that the cold cathode tube CFL1 starts the discharge, high voltage 1K~1.5 KIV usually) must be impressed. This is called open voltage. While the cold cathode tube CFL1 is not lit, since internal resistance of the cold cathode tube CFL1 is very large, when the oscillation frequency of the voltage control oscillator VCO becomes equal to the resonance frequency Fr of the piezoelectric transformer, high voltage is generated at the output terminal of the piezoelectric transformer T1 and the cold cathode tube CFL1 is lit. By this lighting, the internal impedance of the cold cathode tube CFL1 is rapidly decreased. Since the piezoelectric transformer T1 indicates the constant-current characteristics by the internal resistance R, the output of the piezoelectric transformer T1 is decreased. By this characteristics, a ballast capacitor required in a system using winding in the prior art may be omitted. That is, if the power source is turned on, by the soft start circuit of the IC1, the switching frequency of the IC1 starts from frequency higher than that at the normal operation state and is gradually lowered, and when it becomes equal to the resonance frequency Fr of the piezoelectric transformer T1, the CFL1 is lit. Also assuming that thickness of the piezoelectric transformer is d and length is L, the step-up ratio n of the piezoelectric transformer T1 becomes $$n \propto L/d \quad (2)$$

However, n has limitation on account of above-mentioned reason. Also the battery voltage of a notebook personal computer or the like is apt to be lowered more and more, and the step-up ratio of the piezoelectric transformer inevitably becomes large. In the present invention, the step-up chopper is installed at the front stage of the quasi E-class voltage resonance type inverter and the input voltage of the inverter is raised thereby the step-up ratio n of the piezoelectric transformer T1 is raised equivalently.

Next, the soft start operation will be described in detail. The voltage VO of the step-up chopper circuit becomes equation 3 as follows:

$$VO = \frac{Ton + Toff}{Toff} \; VI = \frac{T}{Toff} \quad (3)$$

Figure 7:
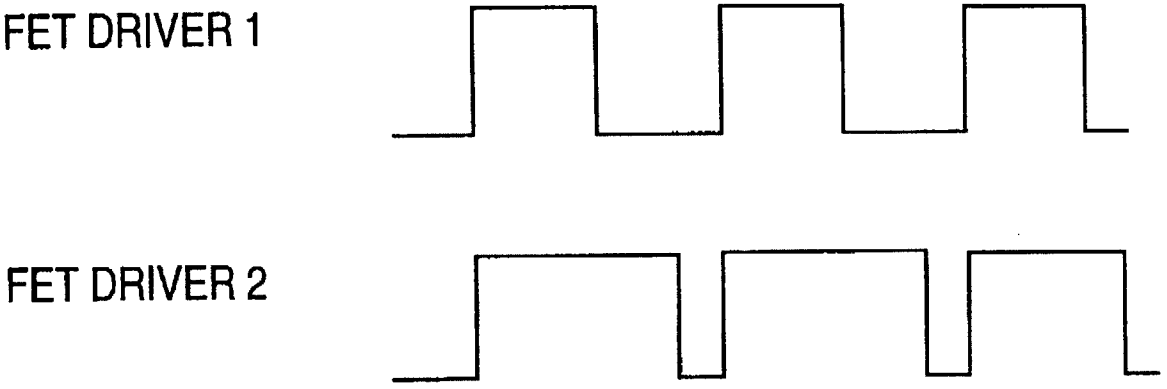
FIG. 7 is a waveform chart of a gate drive circuit.
Figure 8:
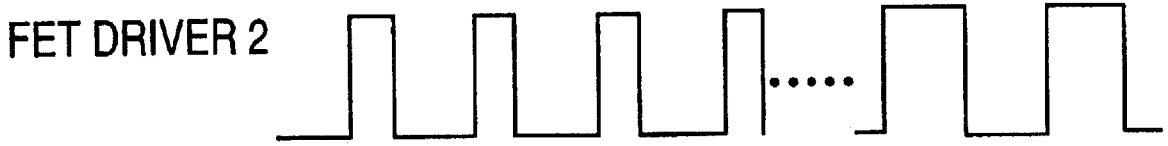
FIG. 8 is a waveform chart of a gate drive circuit FET DRIVER 2.

V1 is input voltage, Ton is the ON-time of the power switch, Toff is the OFF-time, and T is switching period. Consequently, in order that the output voltage VO is made large, Ton must be made large in comparison with Toff. Consequently, the output pulse of the FET DRIVER 1 connected to the PWM circuit, and the ON DUTY is made large and the power MOSFET Q2 of the step-up chopper circuit is driven by the FET DRIVER 2 (refer to FIG. 7). Also when the system rises at the power source ON state or at the state that a lamp current is little, the output voltage of the step-up chopper circuit rises and the excessive voltage stress is applied to the FET. In order to prevent this, the maximum of the ON-time of the power MOSFET (Q1) is determined by the maximum ON-time limit circuit TONMAXLIMIT. That is, if the power switch is turned on, the rise of the power source voltage is detected and the output of the one-shot multivibrator ONE SHOT 2 becomes high level for time T1, and the transistor Q3 connected to the output of the one-shot multivibrator ONE SHOT 2 is turned on. A resistor R9 and a capacitor C8 are CR element determining the time constant. A resistor R8 and a capacitor C6 are CR element for determining the maximum ON-time at the normal state of the maximum ON-time limit circuit TONMAXLIMIT. A resistor R10 connected to the transistor Q3 is set to sufficiently low resistance value in comparison with the R8. If the transistor Q3 is turned on, since the capacitor C6 is charged for time T1 by the resistor R10, the soft start is performed at the state that the ON-time is limited (refer to FIG. 8).

Next, when the input voltage becomes high, a method of suppressing the rise of the output voltage of the step-up chopper will be described. Since the resonance frequency of the piezoelectric transformer is not varied, even if the input voltage of the inverter is varied, operation is performed in the state that the switching frequency of the inverter is not varied. That is, sine the ON DUTY is not varied, if the input voltage of the step-up chopper rises, the output voltage of the step-up chopper rises and the excessive voltage is impressed to the piezoelectric transformer and the transformer is broken. In order to prevent this, variation of the input voltage VCC is detected by the operational amplifier A2, and the ON duty of the PWM circuit is controlled to become small as the input voltage rises, thereby the output of the step-up chopper can be suppressed.

Figure 9:
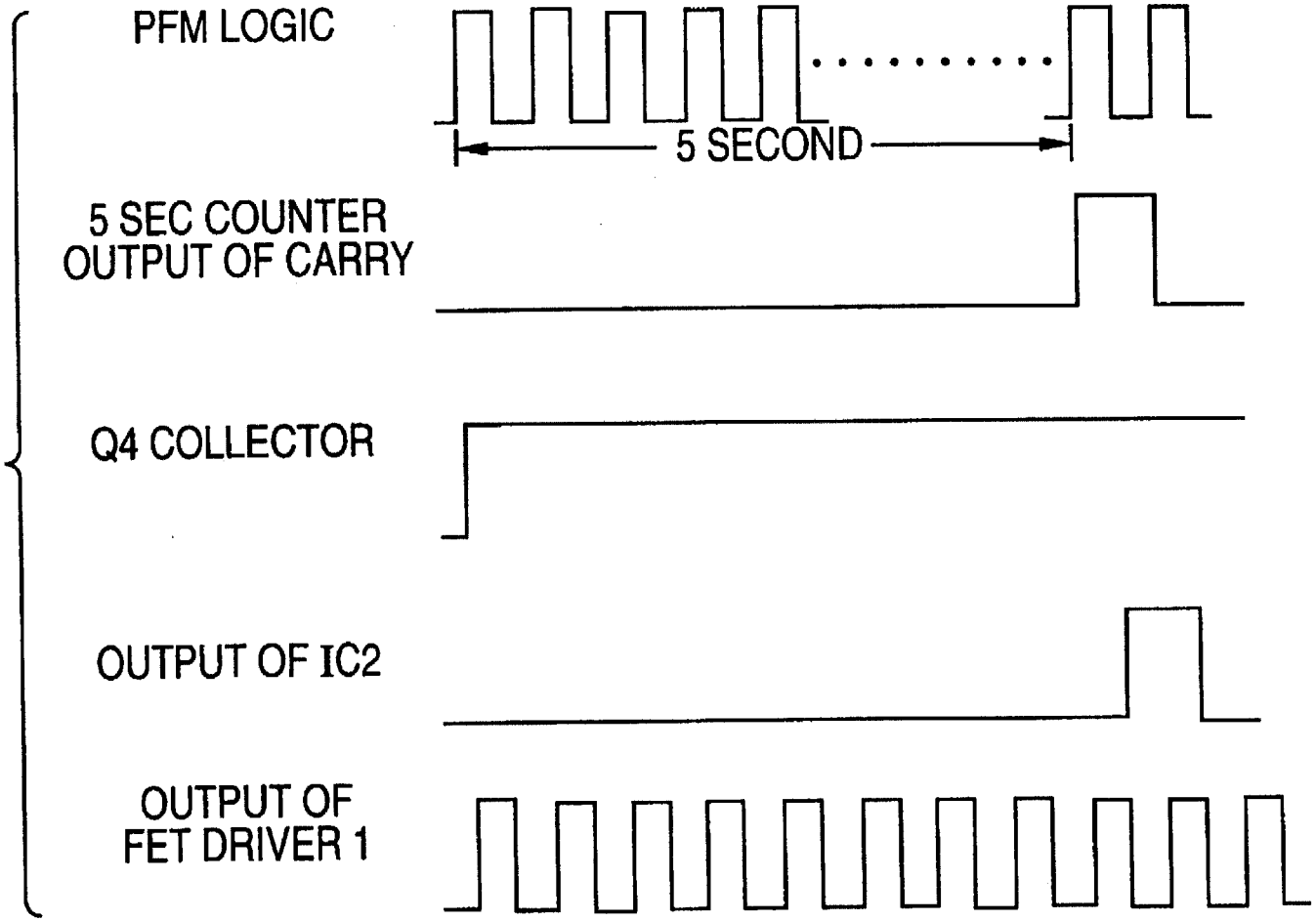
FIG. 9 is a waveform chart of each part of a cold cathode tube lighting device using a piezoelectric transformer according to the invention.

Next, a protective circuit of a piezoelectric transformer will be described. If such state is continued long that a cold cathode tube is not connected in the secondary side of the piezoelectric transformer or it is not lit, large mechanical stress is applied to the piezoelectric transformer and this causes breaking of the piezoelectric transformer. In order to prevent this, switching pulse (output of the PFMLOGIC) is counted for about 5 seconds by the counter 5SECCOUNTER. As a result, CARRY output is obtained. On the other hand, a lamp current is detected by the transistor Q4. If the lamp is not lit, the transistor Q4 is turned off and the collector output becomes high level. The CARRY output of the 5SECCOUNTER and the collector output of the transistor Q4 are connected to the two-input AND IC, IC3, if the state of no connection (no lighting) of the lamp is continued for 5 seconds, the output of the IC3 becomes high level, and since the output is connected to the ON/OFF terminal of the FET DRIVER 1, the output of the FET DRIVER 1 becomes low level and the operation of the inverter is stopped (refer to FIG. 9).

Figure 10:
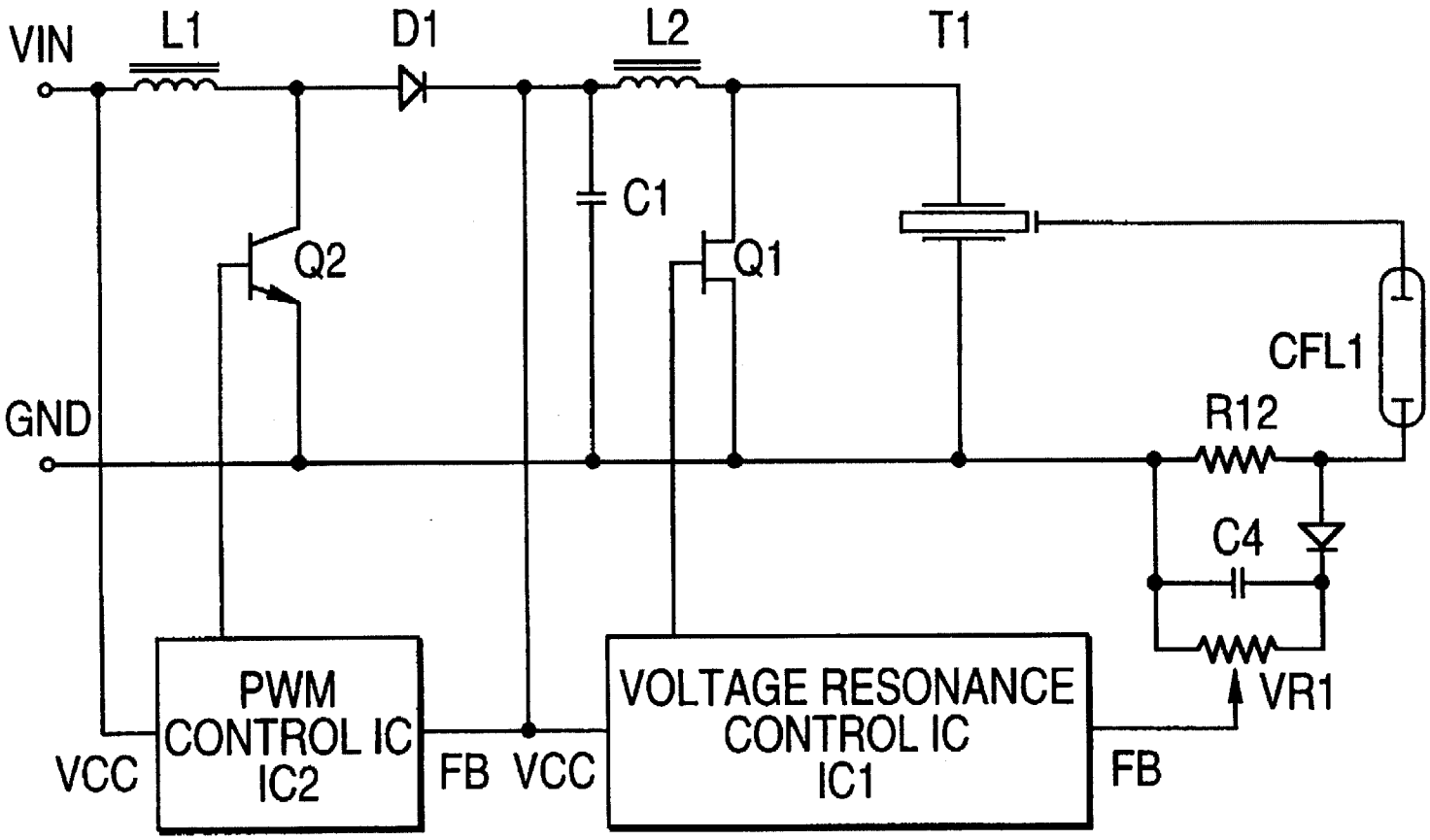
FIG. 10 is a circuit block diagram showing configuration of a second embodiment of the invention.
Figure 11:
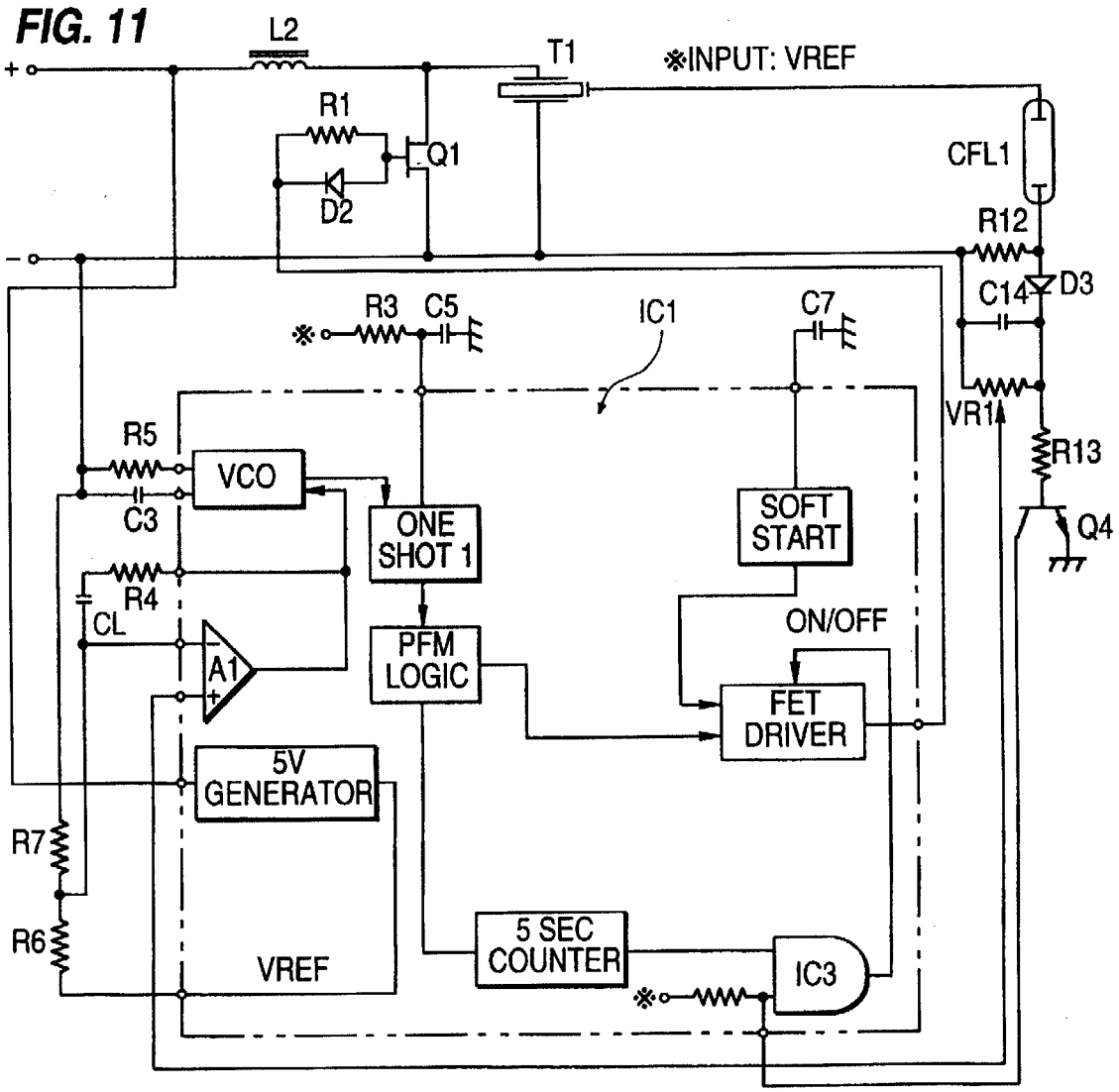
FIG. 11 is a circuit block diagram showing details of a voltage resonance type control IC in the second embodiment.

FIG. 10 shows a second embodiment. A voltage resonance type control IC1 is installed separately from a PWM control IC2 for controlling an inverter. Control of the chopper is performed in the PWM control. Since the output of the chopper is made constant voltage, as function of the control IC, function of performing the soft start while the ON-time is limited and function of suppressing rise of the output voltage of the step-up chopper at the rising of the input voltage are not necessary. FIG. 11 shows a block diagram of the voltage resonance type control IC1.

Figure 12:
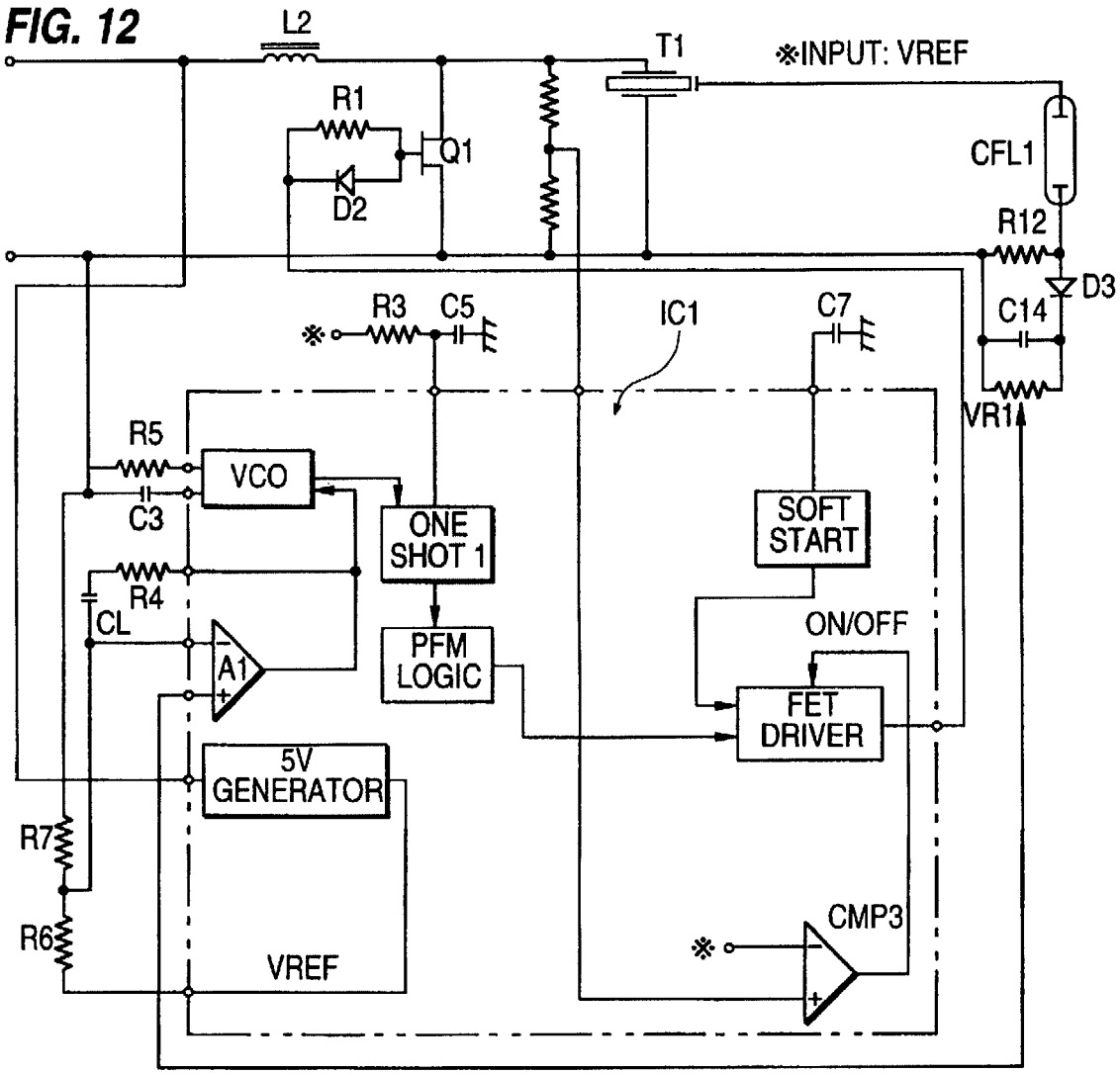
FIG. 12 is a circuit block diagram showing configuration of a third embodiment of the invention.

FIG. 12 shows a third embodiment. When step-up ratio of a piezoelectric transformer T1 is sufficiently large, since the step-up means is not necessary, the device is constituted only by the quasi E-class voltage resonance type inverter.

FIG. 12 illustrates an overvoltage protective circuit. When excessive voltage is impressed to the piezoelectric transformer on account of any reason, primary voltage of the piezoelectric transformer T1 is detected by resistors R13, R14, and the detected voltage is connected to the + input terminal of the comparator CMP3 and if the voltage becomes the setting voltage or more, the comparator CMP3 becomes high level and the FETDRIVER is turned off and the operation of the inverter is stopped.

Next, a lighting control method of a cold cathode tube will be described based on FIG. 1. When the power source is turned on, the switching frequency is gradually lowered by the soft start operation. However, if the speed is rapid, the cold cathode tube is not lit and the switching frequency passes the resonance frequency of the piezoelectric transformer. Consequently, time constant of the SOFT START circuit is made large (value of the resistor R13, the capacitor C7 is made large) and the decreasing speed of the switching frequency is made slow thereby the lighting becomes possible. Since Q of the piezoelectric transformer is very high, closed loop gain of the inverter becomes large, thereby the switching frequency is deviated from the resonance frequency of the piezoelectric transformer due to the disturbance or the like and the cold cathode tube becomes non-lighting state. As the measure for this, the voltage gain is lowered in the high frequency range of the operational amplifier A1, thereby sensitivity to the disturbance can be lowered. As means therefor, the gain—frequency characteristics in the high frequency region is adjusted by the resistor R5 and the capacitor C3 for phase correction of the operational amplifier A1.

As above described in detail, in order to compensate the step-up ratio of the piezoelectric transformer, a step-up chopper is installed at the front stage of the quasi E-class voltage resonance type inverter and constant-current control of the cold cathode tube is performed using the voltage resonance type control IC, thereby the number of parts can be significantly reduced in comparison with the prior art and an inverter circuit with low cost and high efficiency can be provided. Also the resonance frequency of the piezoelectric transformer is made high thereby the lighting frequency of the discharge tube can be made high and the discharge efficiency becomes well.

We claim:

1. A cold cathode tube lighting device having a cold cathode tube and a piezoelectric inverter for lighting the cold cathode tube, wherein a choke coil is connected to primary side of a piezoelectric transformer and a quasi E-class voltage resonance type inverter is thus formed, and a chopper circuit for stepping up an input voltage and supplying a power source to said inverter is installed, and a drive circuit is provided for driving a power switch of the step-up chopper at an ON-time larger than that of the inverter, in synchronization with a drive signal of a power switching element of the inverter.

2. A cold cathode tube lighting device as set forth in claim 1, wherein a soft start circuit is installed so that a switching frequency is gradually decreased from a frequency higher than the resonance frequency of the piezoelectric transformer, while the ON-time of the inverter and the step-up chopper is limited to a definite time.

3. A cold cathode tube lighting device as set forth in claim 1, wherein the ON-time of a power switch of the step-up chopper circuit is decreased as the input voltage becomes higher.

4. A cold cathode tube lighting device as set forth in claim 1, wherein a protective circuit is installed so that if no-connecting state of the cold cathode tube continues over a prescribed time, operation of the inverter is stopped and damage of the piezoelectric transformer is prevented.

5. A cold cathode tube lighting device as set forth in claim 1, wherein an overvoltage protective circuit is installed so that when overvoltage is applied to the piezoelectric transformer, operation of the inverter is stopped simultaneously.

6. A cold cathode tube lighting device as set forth in claim 1, wherein the lighting device is constituted by only the quasi E-class voltage resonance type inverter.

* * * * *